US006947066B2

(12) United States Patent
Sato et al.

(10) Patent No.: US 6,947,066 B2
(45) Date of Patent: Sep. 20, 2005

(54) THERMAL ACTIVATING DEVICE OF THERMAL ACTIVATION SHEET AND PRINTER USING THE THERMAL ACTIVATING DEVICE

(75) Inventors: Yoshinori Sato, Chiba (JP); Minoru Hoshino, Chiba (JP); Akihiko Ito, Chiba (JP); Shinichi Yoshida, Chiba (JP)

(73) Assignee: SII P & S Inc., Chiba (JP)

( * ) Notice: Subject to any disclaimer, the term of this patent is extended or adjusted under 35 U.S.C. 154(b) by 36 days.

(21) Appl. No.: 10/405,127

(22) Filed: Apr. 2, 2003

(65) Prior Publication Data

US 2003/0197775 A1 Oct. 23, 2003

(30) Foreign Application Priority Data

Apr. 22, 2002 (JP) ..... 2002-119675

(51) Int. Cl.[7] ..... B41J 2/325
(52) U.S. Cl. ..... 347/217
(58) Field of Search ..... 347/212, 217–218, 347/220–222, 171–178; 400/120.02, 120.03, 120.04, 120.13, 120.16, 708

(56) References Cited

U.S. PATENT DOCUMENTS 5,541,636 A * 7/1996 Ingram ..... 347/212
5,818,494 A 10/1998 Sato ..... 347/173
5,980,142 A * 11/1999 Inui ..... 400/708
6,031,553 A 2/2000 Nagamoto et al. ..... 347/171
6,297,840 B1 * 10/2001 Inana ..... 347/175
6,339,443 B1 1/2002 Nakanishi et al. ..... 347/200

FOREIGN PATENT DOCUMENTS

EP 0788972 8/1997

* cited by examiner

*Primary Examiner*—K. Feggins
(74) *Attorney, Agent, or Firm*—Adams & Wilks

(57) ABSTRACT

A thermal activating device has an activation heating apparatus for heating and activating a heat sensitive adhesive on a thermal activator layer of a thermal activation sheet. A pressing device presses the thermal activation sheet into pressure contact with the activation heating apparatus to heat and activate the heat sensitive adhesive on the thermal activator layer of the thermal activation sheet. A detector detects the presence of the thermal activation sheet at a predetermined position along its path of travel. A pressure releasing device releases the pressure contact between the thermal activation sheet and the activation heating apparatus when the detector does not detect the presence of the thermal activation sheet at the predetermined position.

32 Claims, 11 Drawing Sheets

THERMAL ACTIVATING DEVICE OF THERMAL ACTIVATION SHEET AND PRINTER USING THE THERMAL ACTIVATING DEVICE

BACKGROUND OF THE INVENTION

1. Field of the Invention

The present invention relates to a thermal activating device of a thermal activation sheet with a thermal activator layer for developing color and adhesion by heating formed on at least one surface thereof and a printer by using the thermal activating device, and more particularly to a technique of preventing a heat sensitive adhesive and a metamorphic material of the heat sensitive adhesive from attaching to the thermal activation sheet.

2. Description of the Related Art

Recently, as one kind of liner-less label, a thermal activation sheet (for example, heat sensitive adhesive label) is in a widespread use in various fields of, for example, a POS label of the foods, logistical and delivery label, label for medical care, baggage tag, display label for bottles and cans, and the like. The heat sensitive adhesive label is designed by forming a heat sensitive adhesive layer for developing the adhesion by heating, although it does not exhibit the adhesion at usual, on the back surface of a sheet-shaped label substrate (for example, base paper) and forming a printable surface on the front surface thereof. The heat sensitive adhesive mainly made from thermoplastic resin, solid elasticizer, and the like and it has a characteristic of developing the adhesion, activated through the heating by the thermal activating device, although it is non-adhesive at room temperature. Usually, the activation temperature is 50 to 150° C., and in this temperature range, a solid elasticizer within the heat sensitive adhesive is melted and the adhesion is added to the thermoplastic resin. Since the melted solid elasticizer is gradually crystallized after a supercooled state, the state of adhesion can last for predetermined hour and while maintaining this state of adhesion, the label is adhered to an object such as a glass bottle.

The printable surface of the heat sensitive adhesive label is formed by, for example, a heat sensitive coloring layer, and a desired letter, image and the like is printed on the printable surface by a thermal printer having a general thermal head, and after the printing, the heat sensitive adhesive layer is activated by the thermal activating device.

A printer is being developed in which the thermal activating device is installed in the thermal printer so as to continuously perform the thermal printing on a heat sensitive adhesive label and the activation of a heat sensitive adhesive layer.

This printer has the structure, for example, as illustrated in FIG. 11.

In FIG. 11, the reference mark P2 indicates a thermal printer unit, the reference mark C2 indicates a cutter unit, the reference mark A2 indicates a thermal activating unit, and the reference mark R indicates a heat sensitive adhesive label reeled like a roll.

The thermal printer unit P2 comprises a printing thermal head 100, a platen roller 101 which is pushed toward the printing thermal head 100, and a driving system (for example, a driving motor, a gear series, and the like), not illustrated, for rotating the platen roller 101. By rotating the platen roller 101 in the direction of D1 (clockwise) in FIG. 11, the heat sensitive adhesive label R is drawn out, and after printing in a thermal method on the heat sensitive adhesive label R drawn out, the label is forwarded in the direction of D2 (in the right direction). The platen roller 101 has pressing means (for example, a coil spring, a flat spring, and the like) not illustrated, and the elastic force is adopted to push the surface of the platen roller 101 to the thermal head 100, serving as the pressuring means of the heat sensitive adhesive label R. The heat sensitive adhesive label R has the structure, for example, as illustrated in FIG. 12. Namely, a thermal coat layer 501 as a heat sensitive coloring layer for forming the printable surface is provided on one surface of the base paper 500 (front surface in FIG. 12) as a label substrate, and on the above layer, a color printing layer 502, for example, with a frame of the price, characters of the unit and the like, pattern, and the like printed there, is formed. A thermal activator layer K, with the heat sensitive adhesive, mainly made from the thermoplastic resin, the solid elasticizer, and the like, applied thereto, is formed on the other surface of the base paper 500 (the back surface in FIG. 12).

The printer unit P2 of FIG. 11 can perform a desired printing on the thermal coat layer 501 of the heat sensitive adhesive label R by operating the printing thermal head 100 and the platen roller 101, according to a printing signal from a printing controller, not illustrated.

The function of the cutter unit C2 is to cut the heat sensitive adhesive label R that has been heat-sensitively printed by the thermal printer unit P2, by a proper length, and it is formed by a movable blade 200, a fixed blade 201, and the like operated by a driving source (not illustrated) of the electric motor and the like. The movable blade 200 is operated at a predetermined timing, according to a control of the controller, not illustrated.

The thermal activating unit A2 is provided with a loading roller 300 and a discharging roller 301 for inserting and discharging the cut heat sensitive adhesive label R, which are rotated, for example, by the driving source not illustrated, and a thermal head 400 for thermal activation and a platen roller 401 pushed toward the thermal head 400 for thermal activation are arranged between the loading roller 300 and the discharging roller 301. The platen roller 401 has a driving system (for example, an electric motor, a gear series, and the like) not illustrated, so as to rotate the platen roller 401 in the direction of D4 (clockwise direction in FIG. 11) and forward the heat sensitive adhesive label R in the direction of D6 (in the right direction in FIG. 11) by the loading roller 300 and the discharging roller 301 rotating respectively in the direction of D3 and in the direction of D5. Further, the platen roller 401 has the pressing means (for example, a coil spring, a flat spring, and the like) not illustrated, and this elastic force is adopted to push the surface of the platen roller 401 toward the thermal head 400 for thermal activation with the pressure F.

That one indicated by the reference mark S is a discharge detecting sensor for detecting the discharge of the heat sensitive adhesive label R. According to the detection of the discharge of the heat sensitive adhesive label R by the discharge detecting sensor S, the next heat sensitive adhesive label R is printed, forwarded, and activated. The thermal head 400 for thermal activation and the platen roller 401 are operated at a predetermined timing by a controller not illustrated, the thermal activator layer K of the heat sensitive adhesive label R is activated by the heat given by the thermal head 400 for thermal activation, thereby developing the adhesion.

After the adhesion of the heat sensitive adhesive label R has been developed by thus constituted thermal printer unit P2, the display label, the price tag, and the advertisement label are stuck to a glass bottle, a plastic bottle, and the like including alcohol, chemicals, and the like. Accordingly, since a separate sheet (liner) such as a conventional general adhesive label sheet is not necessary, it is effective in reducing the cost, and since any separate sheet that will become wastes after use is not required, there is a merit from a viewpoint of the environmental concerns and resource saving.

In the conventional thermal activating unit A2 of the heat sensitive adhesive label R, however, there is a problem such that a heat sensitive adhesive and a metamorphic material of the heat sensitive adhesive (chemically metamorphosed or carbonized material by heat) are attached to the forwarding means (especially, the platen roller 401) of the heat sensitive adhesive label R and the thermal head 400.

Namely, since the platen roller 401 is always in a state of being pushed toward the thermal head 400 by the pressure F, when the heat sensitive adhesive label R is removed from the platen roller 401 after a heater element H of the thermal head 400 for thermal activation has heated and activated the thermal activator layer K of the heat sensitive adhesive label R cut by the cutter unit C2 by a predetermined length, some of the heat sensitive adhesive of the thermal activator layer K is softened by the heating and squeezed out from the space between the platen roller 401 and the thermal head 400 for thermal activation by the pressure F, into a state of being separated from the base paper 500 of the heat sensitive adhesive label R, as illustrated in FIG. 13(*a*).

The heat sensitive adhesive label R is discharged, with the platen roller 401 once in an idle running state, and the heat sensitive adhesive G1 separated as shown in FIG. 13(*a*) comes into a state of sticking around the surface of the platen roller 401 by the adhesion generated by activation, as illustrated in FIG. 13(*b*).

By repeating the states as shown in FIGS. 13(*a*) and (*b*) several times, it turns into a state of sticking a lot of grained heat sensitive adhesives G1 to the surface of the platen roller 401, as illustrated in FIG. 13(*c*). There may occur the case where the stuck heat sensitive adhesives G1 are chemically metamorphosed or transformed into a carbonized material G2 by a lot of heating by the thermal head 400 for thermal activation, hence to be fixedly attached to the surface of the platen roller 401.

Since the heat sensitive adhesive G1 attached to the surface of the platen roller 401 has a stronger adhesion according to the melting through several times of heating by the thermal head 400 for thermal activation, there is a fear of attaching some to the surface of the forwarded heat sensitive adhesive label R and damaging the printing surface.

Further, a lot of attached heat sensitive adhesives G1 damage the smoothness on the surface of the platen roller 401 and thermal activator layer K of the heat sensitive adhesive label R being forwarded cannot be heated uniformly, which causes a situation incapable of bringing out a full adhesion disadvantageously.

SUMMARY OF THE INVENTION

The present invention overcomes the drawbacks of the conventional art by providing a thermal activating device of a thermal activation sheet which can prevent a heat sensitive adhesive and a metamorphic material of the heat sensitive adhesive from attaching to the pressuring means and the activation heating means of the thermal activation sheet. The present invention also relates to a printer using the above thermal activating device.

In order to achieve the above object, the thermal activating device (the thermal activating unit A1) of the thermal activation sheet according to the invention has at least activation heating means (for example, the thermal head 40 and the heater element H) for heating and activating a thermal activator layer of the thermal activation sheet (for example, the heat sensitive adhesive label R) with the thermal activator layer (for example, the thermal activator layer K) formed at least on one surface of a sheet-shaped substrate (for example, the base paper 500), feeding or forwarding means (platen roller 41 for thermal activation and the like) for forwarding the thermal activation sheet in a predetermined direction, and pressing or pushing means for pushing the thermal activation sheet toward the activation heating means, which is designed to comprise thermal activation sheet detecting means (heat sensitive adhesive label detecting sensor S1) for detecting a presence of the thermal activation sheet at a predetermined position, and pressure releasing means (a controller 1500, a cam mechanism 60, and a working mallet member 50) for releasing a pressure working between the pushing means and the activation heating means when judging that the thermal activation sheet does not exist at the predetermined position according to the detection result of the thermal activation sheet detecting means.

Thus, when it is judged that the thermal activation sheet does not exist at the predetermined position, the pressure working between the pushing means and the activation heating means can be released. Accordingly, the thermal activation sheet detecting means can detect a coming of the trailing end of the thermal activation sheet in the vicinity of the activation heating means, for example, and the pressure working between the pushing means and the activation heating means is released, according to the detection signal, thereby preventing the thermal activator from attaching to the activation heating means and the pushing means. Further, the pressure releasing means can release the pressure working between the pushing means and the activation heating means by setting the activation heating means apart from the pushing means in a vertical direction. Thus, the pressure working between the pushing means and the activation heating means can be released.

The pressure releasing means can release the pressure working between the pushing means and the activation heating means by setting the activation heating means apart from the pushing means in a horizontal direction. Thus, the pressure working between the pushing means and the activation heating means can be released.

The activation heating means may be formed by an electric power source, the pushing means may be formed by a platen roller and forcing means for forcing the platen roller toward the electric power source, and the pressure releasing means may be formed by moving means for moving one of the platen roller and the electric power source in a vertical or horizontal direction. Thus, the pressure working between the pushing means and the activation heating means can be released.

Further, the moving means may include a working mallet member vertically movable together with the electric power source, which is provided on the bottom surface of the electric power source, and a cam mechanism attached to one portion of the working mallet member, for converting a rotation motion into a vertical movement, the forcing means may be formed by an elastic member provided on the working mallet member, for forcing the electric power source toward the platen roller, and the cam mechanism may be operated so as to lower the working mallet member against a force of the elastic member when judging that the thermal activation sheet does not exist at the predetermined position according to the detection signal from the thermal activation sheet detecting means. Thus, the thermal activation sheet detecting means can detect a coming of the trailing end of the thermal activation sheet in the vicinity of the activation heating means, for example, and the cam mechanism can be operated according to the detection signal, so to move the electric power source downwardly, thereby setting the electric power source apart from the platen roller. Therefore, the thermal activator of the thermal activation sheet can be prevented from attaching to the electric power source and the surface of the platen roller.

Further, the moving means may include a working mallet member vertically movable together with the electric power source, which is provided on the bottom surface of the electric power source, and an actuator attached to one portion of the working mallet member, for vertically moving the member, the forcing means may be formed by an elastic member provided on the working mallet member, for forcing the electric power source toward the platen roller, and the actuator may be operated so as to lower the working mallet member against a force of the elastic member when judging that the thermal activation sheet does not exist at the predetermined position according to the detection signal from the thermal activation sheet detecting means. Thus, the thermal activation sheet detecting means can detect a coming of the trailing end of the thermal activation sheet in the vicinity of the activation heating means, for example, and the actuator may be operated according to the detection signal, so to move the electric power source downwardly, thereby setting the electric power source apart from the platen roller. Therefore, the thermal activator of the thermal activation sheet can be prevented from attaching to the electric power source and the surface of the platen roller.

Further, the moving means may include a working mallet member vertically movable together with the platen roller, and a cam mechanism attached to one portion of the working mallet member, for converting a rotation motion into a vertical movement, the forcing means may be formed by an elastic member provided on the working mallet member, for forcing the platen roller toward the electric power source, and the cam mechanism may be designed so as to raise the working mallet member against a force of the elastic member when judging that the thermal activation sheet does not exist at the predetermined position according to the detection signal from the thermal activation sheet detecting means. Thus, the thermal activation sheet detecting means can detect a coming of the trailing end of the thermal activation sheet in the vicinity of the activation heating means, for example, and the cam mechanism can be operated according to the detection signal, so to move the platen roller upwardly, thereby setting the platen roller apart from the electric power source. Therefore, the thermal activator of the thermal activation sheet can be prevented from attaching to the electric power source and the surface of the platen roller.

Further, the moving means may include a working mallet member vertically movable together with the platen roller, and an actuator attached to one portion of the working mallet member, for vertically moving the member, the forcing means may be formed by an elastic member provided on the working mallet member, for forcing the platen roller toward the electric power source, and the actuator may be operated so as to raise the working mallet member against a force of the elastic member when judging that the thermal activation sheet does not exist at the predetermined position according to the detection signal from the thermal activation sheet detecting means. Thus, the thermal activation sheet detecting means can detect a coming of the trailing end of the thermal activation sheet in the vicinity of the activation heating means, for example, and the actuator can be operated according to the detection signal, so to move the platen roller upwardly, thereby setting the platen roller apart from the electric power source. Therefore, the thermal activator of the thermal activation sheet can be prevented from attaching to the electric power source and the surface of the platen roller.

Further, the actuator may be formed by one of a solenoid, a pneumatic cylinder, and a hydraulic cylinder. Thus, vertical movement of the electric power source or the platen roller can be realized at ease.

Further, a power supply to the electric power source may be broken in associated with an operation of the pressure releasing means. This can prevent from baking and the like of some thermal activator possible to attach to the electric power source. Further, the power consumption can be saved by cutting the power supply to the electric power source when the thermal activation is not necessary.

Further, the thermal activation sheet detecting means can be formed by an optical sensor or a microswitch capable of detecting a coming of a leading end or a trailing end of the thermal activation sheet. Thus, the detection of the thermal activation sheet can be surely realized at a low cost.

Further, one or more thermal activation sheet detecting means may be provided on a way of passage of the thermal activation sheet by the forwarding means. Thus, the presence of the thermal activation sheet at the predetermined position (for example, the position of providing the electric power source) can be surely detected.

It may further comprise controlling means for deciding an operation timing of the pressure releasing means, according to forwarding direction and length information of the thermal activation sheet, forwarding speed information of the thermal activation sheet by the forwarding means, distance information from the thermal activation sheet detecting means to the activation heating means, and the detection result of the thermal activation sheet detecting means. This can operate the pressure releasing means at a proper operation timing even when the length of the thermal activation sheet is changed.

The forwarding direction and length information of the thermal activation sheet may be obtained according to the detection result of the thermal activation sheet detecting means and the forwarding speed information of the thermal activation sheet by the forwarding means. This can obtain the length of the thermal activation sheet accurately and operate the pressure releasing means at a proper operation timing.

The forwarding speed information of the thermal activation sheet by the forwarding means may be obtained according to the detection result by several thermal activation sheet detecting means. This can obtain the forwarding speed information of the thermal activation sheet accurately, calculate the length of the thermal activation sheet accurately, and operate the pressure releasing means at a proper operation timing.

Further, the electric power source may be formed by a thermal head with a plurality of heater elements aligned there. Thus, by diverting the thermal head for use in a thermal printer, for example, the thermal activating device of the thermal activation sheet can be realized as ease.

Further, the electric power source may be formed by a so-called thermal bar including a single resistive element.

Thus, by diverting the thermal bar for use in a thermal printer and the like, for example, the thermal activating device of the thermal activation sheet can be realized at ease.

Further, the electric power source may be formed by a thermal roll including a cylindrical resistive element. Thus, by diverting the thermal roll for use in a laser printer and the like, for example, the thermal activating device of the thermal activation sheet can be realized at ease.

Further, the thermal activator may be formed by not only the thermal activation adhesive material but also a heat sensitive recording material, an electrostatic ink toner, and the like. Thus, the heat sensitive recording material can be prevented from attaching to the electric power source and the platen roller when using heat sensitive paper and the like with the heat sensitive recording material applied thereon, for example, as the thermal activation sheet.

Further, the platen roller has a driving source for directly rotating the platen roller, serving as the forwarding means.

A printer according to another invention, is designed to comprise one of the above-mentioned thermal activating devices of the thermal activation sheets. This can realize the printer for thermal activation sheet free from damaging the thermal activation sheet.

Further, the printer may have a thermal head for printing while making contact with the heat sensitive coloring layer of the thermal activation sheet with a heat sensitive coloring layer formed thereon. This enables continuous printing to the thermal activation sheet and activation of the thermal activator layer.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERRED EMBODIMENTS

Hereinafter, preferred embodiments of the invention will be described with reference to the drawings.

Figure 1:
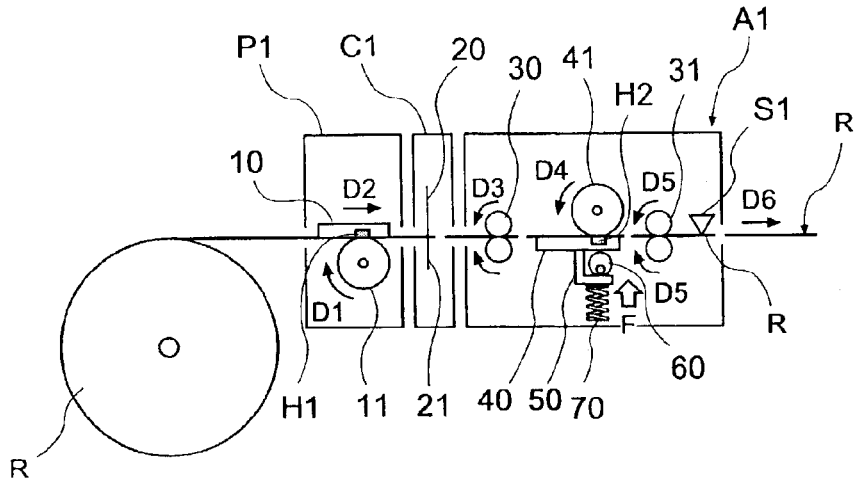
FIG. 1 is a schematic view showing the structure of a thermal printer according to the invention.
Figure 2:
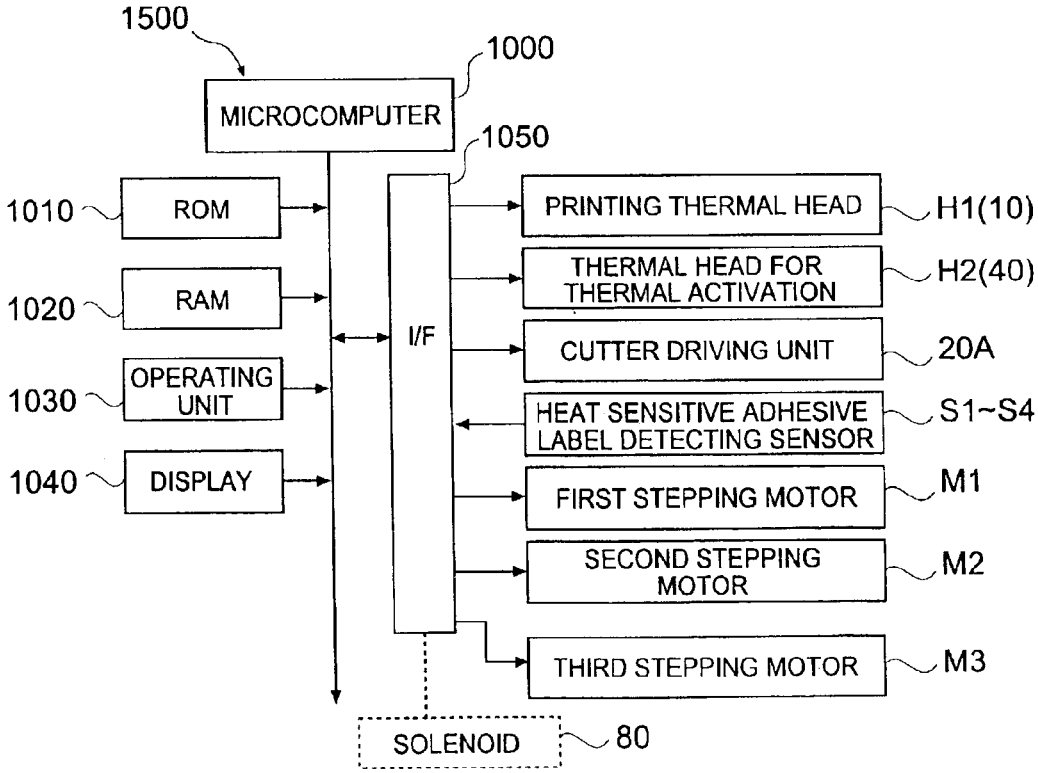
FIG. 2 is a block diagram showing the structure of a controller of the thermal printer.

FIG. 1 is a schematic view showing the structure of a thermal printer according to the invention, and FIG. 2 is a control block diagram of the thermal printer. In FIG. 1, the reference mark P1 indicates a thermal printer unit, the reference mark C1 indicates a cutter unit, the reference mark A1 indicates a thermal activating unit as a thermal activating device, and the reference mark R indicates a heat sensitive adhesive label as the thermal activation sheet reeled like a roll.

The thermal printer unit P1 has the general structure comprising a printing thermal head 10, a platen roller 11 pushed toward the printing thermal head 10, and a driving system (for example, a first stepping motor M1, a gear series, and the like), not illustrated, for rotating the platen roller 11.

By rotating the platen roller 11 in the direction of D1 (clockwise) in FIG. 1, the heat sensitive adhesive label R is drawn out and the heat sensitive adhesive label R drawn out is printed in a thermal method, hence to be forwarded in the direction of D2 (in the right direction). The platen roller 11 has the pressuring means (for example, a coil spring, a flat spring, and the like) not illustrated, and the elastic force is adopted to push the surface of the platen roller 11 toward the printing thermal head 10 with the pressure F.

A heater element H1 of the printing thermal head 10 is formed by a plurality of comparatively small resistive elements aligned in the width direction of the head in a way capable of dot printing. While, a heater element H2 of the thermal head 40 for thermal activation as the electric heat source, described later, does not have to be separated by the dot unit, differently from the heater element for printing, but it may be a continuous resistive element like a thermal bar used for a laser printer and the like. Instead of the thermal head and the thermal bar, a thermal roll for rotating a cylindrical resistive element used for a laser printer and the like may be adopted.

By using a resistive element of the same structure respectively for the printing thermal head 10 and the thermal head 40 for thermal activation, the component can be used in common and the cost can be reduced.

Figure 12:
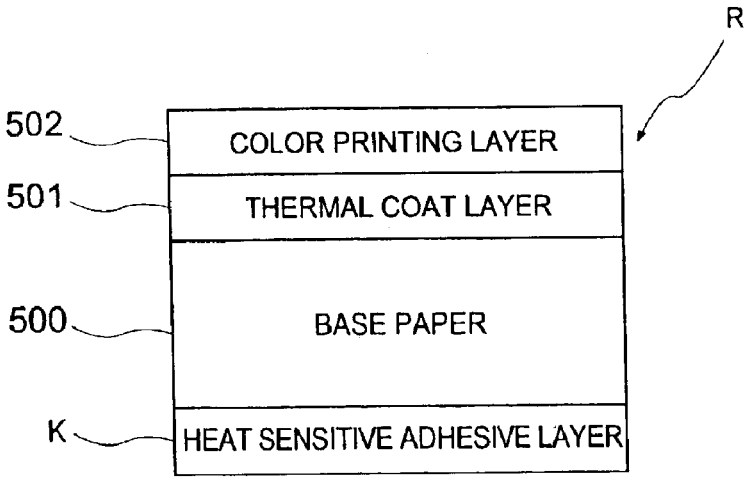
FIG. 12 is a cross section view showing the structure of the thermal activation sheet.
Figure 13A:
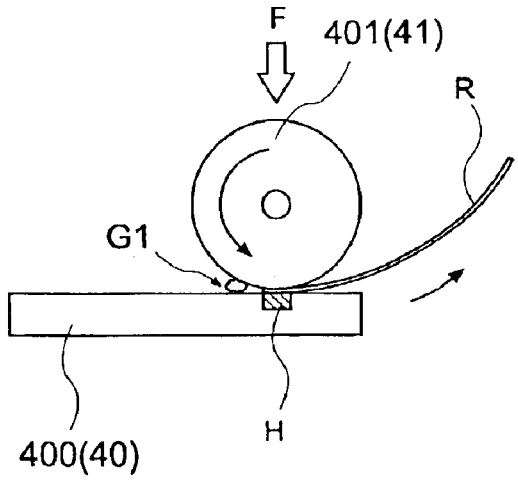
FIG. 13A PRIOR ART
FIG. 13 is an explanatory view showing the attached state of the heat sensitive adhesive and the like in the conventional thermal activating device.
Figure 13B:
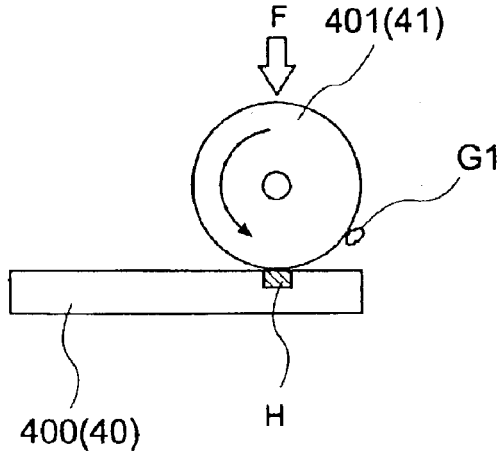
FIG. 13B PRIOR ART
Figure 13C:
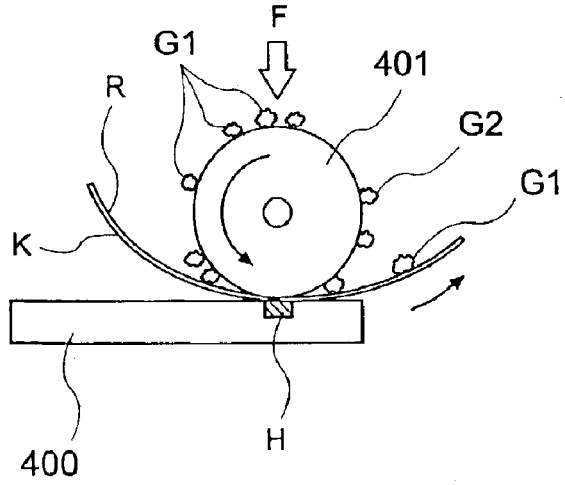
FIG. 13C PRIOR ART

The heat sensitive adhesive label R used in this embodiment has the structure, for example, as shown in the above-mentioned FIG. 12. Depending on necessity, an insulating layer may be provided on the base paper 500.

The printing thermal head 10 (heater element H1) and the printing platen roller 11 (first stepping motor M1) are operated according to a printing signal from the controller described later 1500, and hence a desired printing can be performed on the thermal coat layer 501 of the heat sensitive adhesive label R.

The cutter unit C1 is to cut the heat sensitive adhesive label R that has been heat-sensitively printed by the thermal printer unit P1, by a proper length, and it is formed by a movable blade 20, a fixed blade 21, and the like operated by a driving source (not illustrated) of an electric motor and the like. A cutter driving unit 20A, not illustrated, of the movable blade 20, is operated at a predetermined timing according to a control of the controller described later 1500.

The thermal activating unit A1 is rotated according to, for example, a driving source (a second stepping motor M2) not illustrated, and it comprises a loading roller 30 and a discharging roller 31 for inserting and discharging the cut heat sensitive adhesive label R. A thermal head 40 for thermal activation and a platen roller 41 for thermal activation pushed toward the thermal head 40 for thermal activation are provided between the loading roller 30 and the discharging roller 31. The platen roller 41 for thermal activation has a driving system (for example, the second stepping motor M2, a gear series, and the like), for rotating the platen roller 41 for thermal activation in the direction of D4 (clockwise) in FIG. 1), so as to forward the heat sensitive adhesive label R in the direction of D6 (right direction in FIG. 1), according to the loading roller 30 and the discharging roller 31 rotating respectively in the direction of D3 and the direction of D5. The platen roller 41 for thermal activation is made of, for example, hard rubber and the like.

An L-shaped moving mallet member 50 vertically movable with the thermal head 40 for thermal activation is provided in the bottom surface of the thermal head 40 for thermal activation, and the top surface 50*a* of the moving mallet member 50 makes contact with the circumferential surface of an eccentric cam 61 of a cam mechanism 60 in a fluctuating way. The cam mechanism 60 comprises a driving source (a third stepping motor M3) driven by the controller described later 1500, and the eccentric cam 61 is fixed around a rotation axis 62 of the third stepping motor M3.

A coil spring 70 is provided on the bottom surface 50*b* of the moving mallet member 50 as forcing means, which pushes the thermal head 40 for thermal activation toward the platen roller 41 for thermal activation through the moving mallet member 50.

The reference mark S1 indicates a sensor for detecting a heat sensitive adhesive label as the thermal activation sheet detecting means for detecting the position of the heat sensitive adhesive label R, which is formed by a photo sensor, a microswitch, or the like.

Figure 3A:
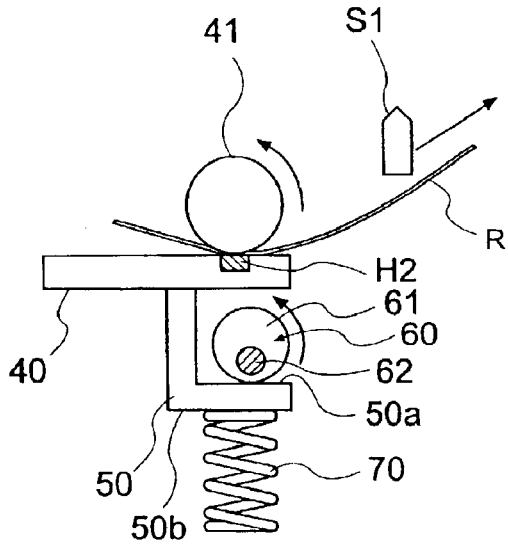
FIG. 3 is an explanatory view showing the schematic structure of an embodiment of the pressure releasing means.
Figure 3B:
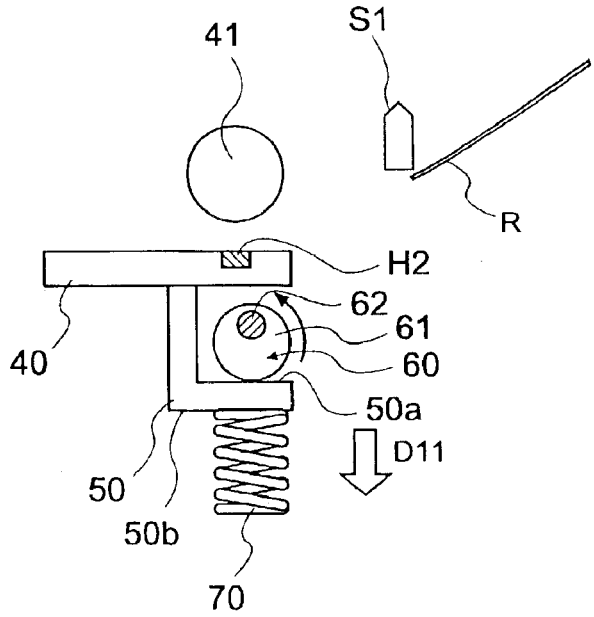

As illustrated in FIG. 3(*a*), the thermal head 40 for thermal activation is pushed toward the platen roller 41 for thermal activation, into a state of pinching the heat sensitive adhesive label R therebetween. When the cam mechanism 60 is operated, according to the detection of the position of the heat sensitive adhesive label R by the heat sensitive adhesive label detecting sensor S1, the thermal head 40 for thermal activation starts falling down, as illustrated in FIG. 3(*b*), and the state of pushing the thermal head 40 for thermal activation toward the platen roller 41 for thermal activation is released. Thus, the heat sensitive adhesive can be prevented from attaching to the thermal head 40 for thermal activation and the platen roller 41 for thermal activation. The controller 1500 of the thermal printer comprises, as shown in FIG. 2, a microcomputer 1000 of one chip for managing a controlling unit, a ROM 1010 for storing a control program and the like executed by the microcomputer 1000, a RAM 1020 for storing various printing formats and the like, an operating unit 1030 for receiving, setting, or calling the printing data, the printing format data, and the like, a display 1040 formed by a liquid crystal display panel and the like for displaying the printing data and the like, and an interface 1050 for performing the input/output of the data between the controlling unit and the driving devices.

The heater element H1 of the printing thermal head 10 of the printer unit P1, the heater element H2 of the thermal head 40 for thermal activation of the thermal activating unit A1, a cutter driving unit 20A of the cutter unit C1, the first to the third stepping motors M1 to M3, and the heat sensitive adhesive label detecting sensor S1 are respectively connected to the interface 1050.

A solenoid 80 may be connected there, instead of the third steeping motor M3, as described later.

When the operation of the thermal printer is started according to the control of the controller 1500, the thermal printing is performed on the printable surface (thermal coat layer 501) of the heat sensitive adhesive label R by the thermal printer unit P1. Successively, the heat sensitive adhesive label R forwarded to the cutter unit C1 according to the rotation of the printing platen roller 11 is cut into a predetermined length by the movable blade 20 operated by the cutter driving unit 20A at a predetermined timing.

Successively, the heat sensitive adhesive label R after cut is taken into the thermal activating unit A1 by the loading roller 30 of the thermal activating unit A1 and a heat energy is applied to the above label R by the thermal head 40 for thermal activation (heater element H) and the platen roller 41 for thermal activation operated at a predetermined timing. Thus, the thermal activator layer K of the heat sensitive adhesive label R is activated to develop the adhesion. Successively, the label R is discharged out from the thermal printer according to the operation of the discharging roller 31.

When the heat sensitive adhesive label detecting sensor S1 detects absence of the heat sensitive adhesive label R, the third stepping motor M3 of the cam mechanism 60 is driven according to the detection signal, the eccentric cam 61 is rotated, the thermal head 40 for thermal activation is lowered, as illustrated in FIG. 3(*b*), and the pressed state of the thermal head 40 for thermal activation toward the platen roller 41 for thermal activation is released.

Thus, after the thermal activator layer K of the heat sensitive adhesive label R has been heated and activated by the heater element H of the thermal head 40 for thermal activation, when the heat sensitive adhesive label R is removed from the platen roller 41 for thermal activation, even if some of the heat sensitive adhesive of the thermal activator layer K is squeezed out between the platen roller 41 for thermal activation and the thermal head 40 for thermal activation because of heating and softening, and peeled out from the base paper 500 of the heat sensitive adhesive label R, such a situation that the heat sensitive adhesive sticks to the thermal head 40 for thermal activation and the platen roller 41 for thermal activation can be assuredly prevented because the thermal head 40 for thermal activation is away from the platen roller 41 for thermal activation.

Accordingly, when the thermal activating unit A1 performs the thermal activation on the heat sensitive adhesive label R being forwarded next, it is possible to previously prevent from a situation of damaging the printing surface, depositing the heat sensitive adhesive on the peripheral surface of the platen roller 41 for thermal activation, and accordingly making uneven the contact with the thermal head 40 for thermal activation and make insufficient the thermal activation.

As illustrated in FIG. 3(*b*), in a separate state of the thermal head 40 for thermal activation and the platen roller 41 for thermal activation, power supply to the thermal head 40 for thermal activation may be broken according to a control of the controller 1500. Accordingly, the power consumption can be saved by cutting the power supply to the thermal head 40 for thermal activation when the thermal activation is not necessary.

In the embodiment shown in FIG. 3, although the description has been made in the case of providing the heat sensitive adhesive label detecting sensor S1 on the downstream side from the platen roller 41 for thermal activation and the thermal head 40 for thermal activation in the forwarding direction of the heat sensitive adhesive label R, the position of the heat sensitive adhesive label detecting sensor is not restricted to this.

Figure 4A:
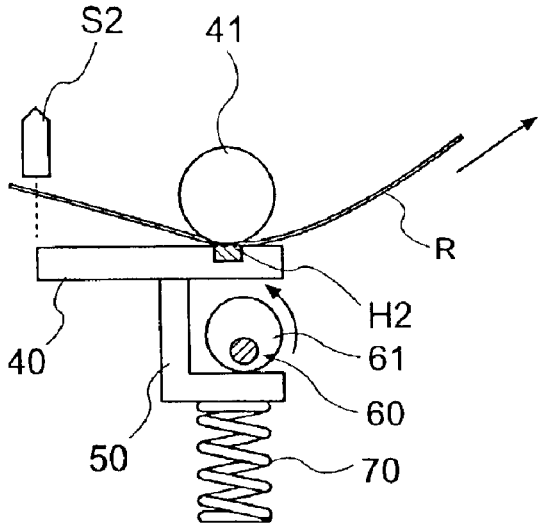
FIG. 4 is an explanatory view showing the position of the heat sensitive adhesive label detecting sensor of the pressure releasing means.
Figure 4B:
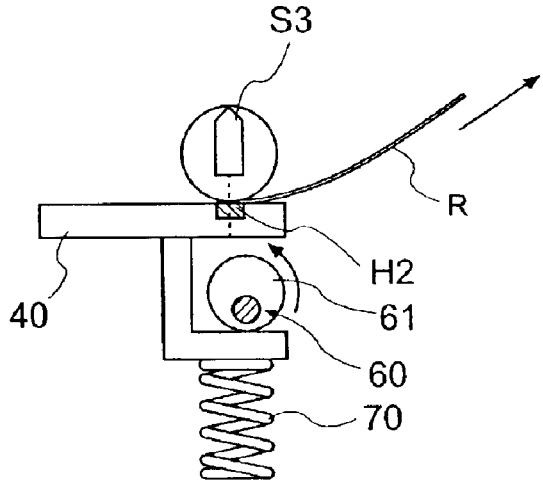
Figure 4C:
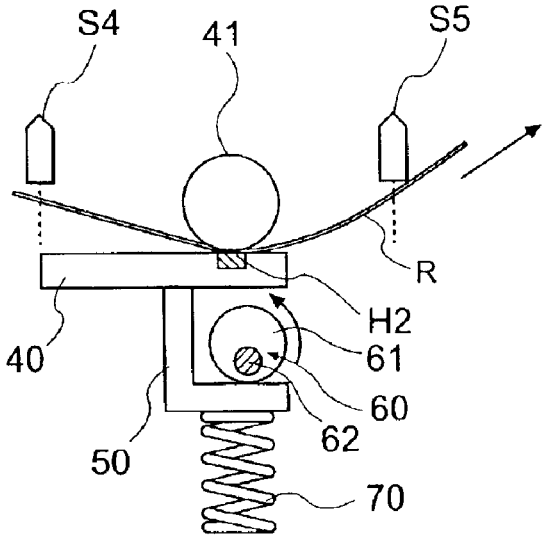

Namely, as illustrated in FIG. 4(*a*), the heat sensitive adhesive label detecting sensor S2 may be provided on the upstream side from the platen roller 41 for thermal activation and the thermal head 40 for thermal activation in the forwarding direction of the heat sensitive adhesive label R. Alternatively, as illustrated in FIG. 4(*b*), the heat sensitive adhesive label detecting sensor S3 may be provided in the substantially same position as that of the platen roller 41 for thermal activation and the thermal head 40 for thermal activation.

Alternatively, as illustrated in FIG. 4(*c*), two heat sensitive adhesive label detecting sensors S4 and S5 may be provided on the upstream and downstream sides from the platen roller 41 for thermal activation and the thermal head 40 for thermal activation in the forwarding direction of the heat sensitive adhesive label R. In this case, the information about the length and the forwarding speed of the heat sensitive adhesive label R can be calculated according to the detection signals of the leading end portion and the trailing end portion of the heat sensitive adhesive label R by the heat sensitive adhesive label detecting sensors S4 and S5, and based on the information, the third stepping motor M3 of the cam mechanism 60 can be operated at a proper timing. The details of the pressure releasing processing for controlling the pressure releasing means such as the cam mechanism 60 according to the length information, the forwarding speed information, and the like of the heat sensitive adhesive label R will be described later, according to the flow charts.

In the embodiment shown in FIG. 3, although the description has been made in the case of using the cam mechanism 60 having the eccentric cam 61 as a mechanism for lowering the moving mallet member 50, it is not restricted to this, but instead of the cam mechanism 60, a solenoid, a pneumatic cylinder, a hydraulic cylinder, and the like may be used so as to lower the moving mallet member 50 according to the telescopic motion of the rod. Alternatively, a combination of gear series can be used in order to lower the moving mallet member 50.

Next, another embodiment of the pressure releasing means in the thermal activating unit A1 will be described with reference to FIG. 5.

In this embodiment, the platen roller 41 for thermal activation is attached to the moving mallet member 51 in a rotatable way, and the telescopic rod 81 of the solenoid 80 affects the moving mallet member 51, so as to raise the moving mallet member 51 together with the platen roller 41 for thermal activation, thereby setting the platen roller 41 for thermal activation apart from the thermal head 40 for thermal activation.

Figure 5A:
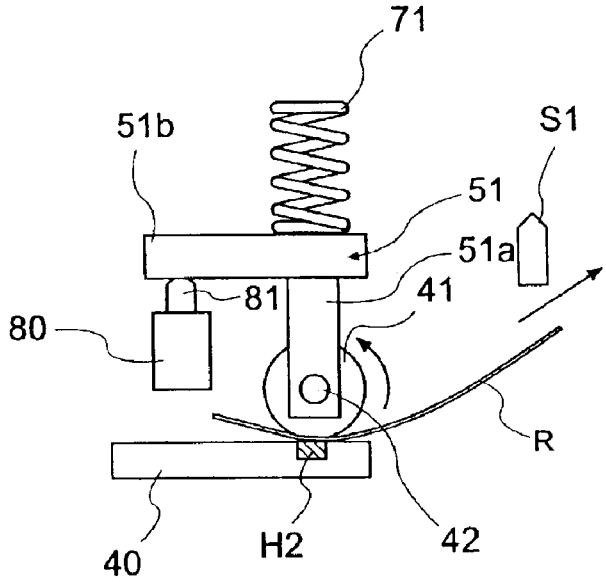
FIG. 5 is an explanatory view showing the schematic structure of another embodiment of the pressure releasing means.
Figure 5B:
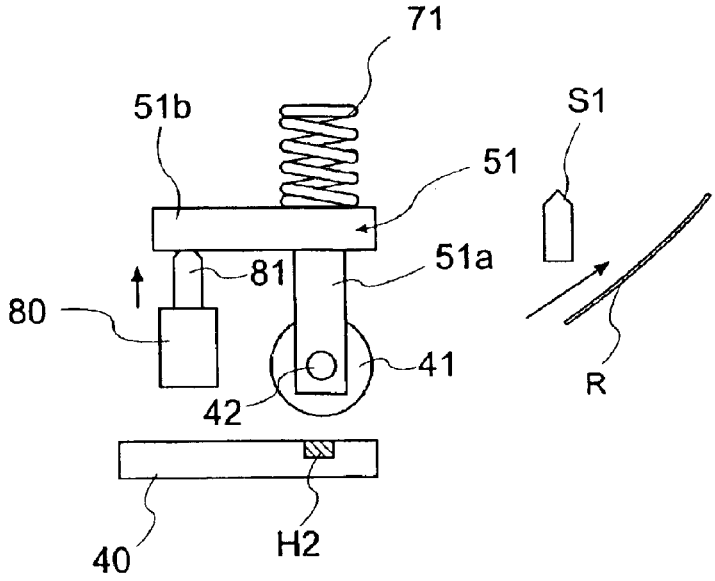

More specifically, as illustrated in FIG. 5(*a*), the platen roller 41 for thermal activation is supported by an axis in a rotatable way in the lower portion of the vertical portion 51*a* of the L-shaped moving mallet member 51 and the solenoid 80 having the telescopic rod 81 is provided under the horizontal portion 51*b* of the moving mallet member 51. The telescopic rod 81 of the solenoid 80 is usually attached to the bottom surface of the horizontal portion 51*b* of the moving mallet member 51 in a contracted state. The solenoid 80 is connected to the controller 1500 through the interface 1050, as illustrated by a chained line in the above-mentioned FIG. 2, so to be operated at a predetermined timing by a control of a microcomputer 1000.

Further, as the forcing means, a coil spring 71 is provided on the top surface of the horizontal portion 51*b* of the moving mallet member 51, so as to push the platen roller 41 for thermal activation toward the thermal head 40 for thermal activation through the moving mallet member 51, as illustrated in FIG. 5(*a*).

The reference mark S1 is the heat sensitive adhesive label detecting sensor as the thermal activation sheet detecting means for detecting the position of the heat sensitive adhesive label R, which is formed by a photo sensor, a microswitch, or the like.

As illustrated in FIG. 5(*a*), the platen roller 41 for thermal activation is pushed toward the thermal head 40 for thermal activation, and from a state of pinching the heat sensitive adhesive label R therebetween, according to the detection of the position of the heat sensitive adhesive label R by the heat sensitive adhesive label detecting sensor S1, the solenoid 80 is operated and the telescopic rod 81, the thermal head 40 for thermal activation starts falling down, as illustrated in FIG. 3(*b*), and the state of pushing the thermal head 40 for thermal activation toward the platen roller 41 for thermal activation is released. Thus, the heat sensitive adhesive can be prevented from attaching to the thermal head 40 for thermal activation and the platen roller 41 for thermal activation.

In the embodiment shown in FIG. 5, although the description has been made in the case of using the solenoid 80 as the moving means for raising up the moving mallet member 51 and the platen roller 41 for thermal activation, it is not restricted to this. Instead of the solenoid, a pneumatic cylinder, a hydraulic cylinder, and the like can be used. Further, instead of the solenoid, a cam mechanism as shown in the above-mentioned FIG. 3 may be provided so as to raise the moving mallet member 51 and the platen roller 41 for thermal activation according to the rotation of the eccentric cam. Alternatively, a combination of gear series may be considered so as to raise the moving mallet member 51.

The position and the number of the heat sensitive adhesive label detecting sensor may be properly changed, similarly to the above-mentioned embodiment (refer to FIG. 4).

The pressure releasing processing performed by the controller 1500 will be described with reference to the flow charts of FIG. 6 to FIG. 10, this time.

Figure 6:
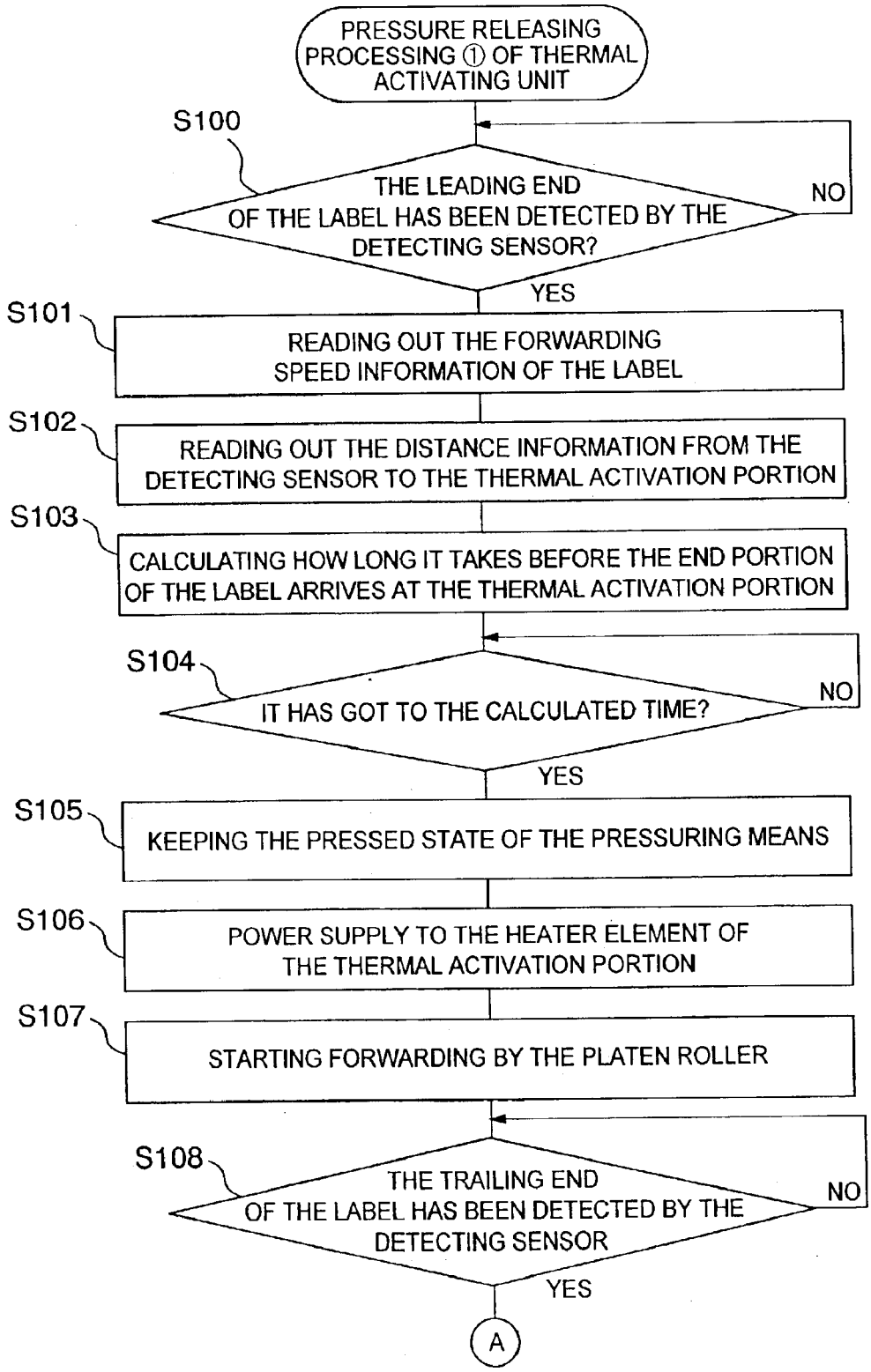
FIG. 6 is a flow chart showing the procedure of the pressure releasing processing ① of the thermal activating unit.
Figure 7:
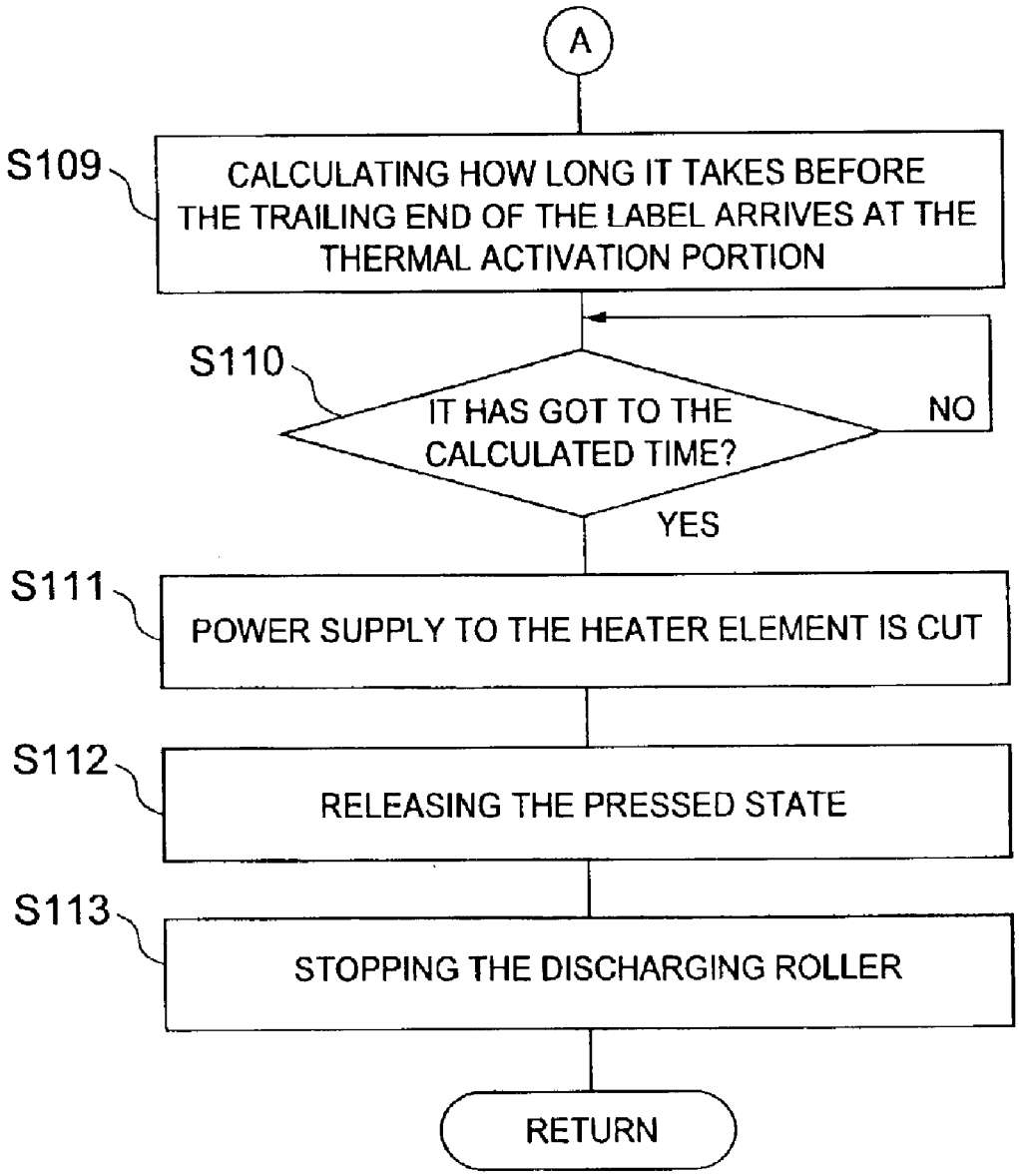
FIG. 7 is a flow chart showing the continuation of the processing of FIG. 6.

FIG. 6 and FIG. 7 are flow charts showing the procedure of the pressure releasing processing ① of the thermal activating unit in the case of providing one heat sensitive adhesive label detecting sensor S1 on the upstream side from the thermal head 40 for thermal activation and the platen roller 41 for thermal activation in the forwarding direction of the heat sensitive adhesive label R, as illustrated in FIG. 4(*a*).

When this processing is started, in Step S100, first it is checked whether the heat sensitive adhesive label detecting sensor S1 has detected the leading end of the heat sensitive adhesive label R; when it is judged that it has detected, the procedure moves to Step S101, where the forwarding speed information of the forwarding means (for example, the platen roller 41 for thermal activation) previously stored in the ROM 1010 or the RAM 1020 of the controller 1500 is read out, and then the procedure moves to Step S102. In Step S102, the distance information from the heat sensitive adhesive label detecting sensor S1 to the thermal activation portion (the heater element H2 of the thermal head 40 for thermal activation), previously stored in ROM 1010 or RAM 1020 of the controller, is read out and then, the procedure moves to Step S103.

In Step S103, how long it takes before the end portion of the heat sensitive adhesive label R arrives at the thermal activation portion is calculated (distance information/forwarding speed information), and then the procedure moves to Step S104. In Step S104, it is checked whether it has got to the calculated time, and when it has got to the above time, the procedure moves to Step S105.

In Step S105, the pressed state by the pressuring means is kept (namely, for example, in the case of using the cam mechanism, the eccentric cam 61 is attached to the moving mallet member 51 at the bottom dead center, as illustrated in FIG. 3(*a*), and in the case of using the solenoid, the telescopic rod 81 is in a contracted state (off-state), as illustrated in FIG. 5(*a*)) and the procedure moves to Step S106, where the power supply to the thermal activation portion (heater element H2) is started.

Then, the procedure moves to Step S107, where the forwarding of the heat sensitive adhesive label R by the platen roller 41 for thermal activation is started. Thus, the thermal activation of the heat sensitive adhesive label R is started.

The procedure moves to Step S108, where it is checked whether the heat sensitive adhesive label detecting sensor S1 has detected the trailing end of the heat sensitive adhesive label R, and when it is judged that it has detected, the procedure moves to Step S109. In Step S109, how long it takes before the tailing end of the heat sensitive adhesive label R arrives at the thermal activation portion (heater element H2) is calculated, and then the procedure moves to Step S110.

In Step S110, it is checked whether it has got to the calculated time, and when it has got to the above time, the procedure moves to Step S111, where the power supply to the heater element H2 is cut, and then the procedure advances to Step S112. This can save the power consumption when the thermal activation of the heat sensitive adhesive label R is not required. In Step S112, the pressed state by the pressuring means is released. Namely, for example, in the case of using the cam mechanism 60 as the pressure releasing means, as illustrated in FIG. 4, the third stepping motor M3 is driven so to rotate the eccentric cam 61, and as illustrated in FIG. 3(*b*), the moving mallet member 50 is lowered, so as to set the thermal head 40 for thermal activation apart from the platen roller 41 for thermal activation, thereby releasing the pressed state. In the case of using the solenoid 80 as the pressure releasing means, as illustrated in FIG. 5, the solenoid 80 is turned on, so to expand the telescopic rod 81 and raise the moving mallet member 51, as illustrated in FIG. 5(*b*), so as to set the thermal head 40 for thermal activation apart from the platen roller 41 for thermal activation, thereby releasing the pressed state. Then, the procedure moves to Step S113, where the rotation of the discharging roller 31 is stopped and returned.

In these ways, the pressed state of the thermal head 40 for thermal activation toward the platen roller 41 for thermal activation can be released, thereby preventing the heat sensitive adhesive from attaching to the thermal head 40 for thermal activation and the platen roller 41 for thermal activation. In the pressure releasing processing ①, since the system calculates how long it takes before the leading end and the trailing end of the heat sensitive adhesive label R arrive at the heater element H2, and so on and determines the timing for releasing the pressed state according to the calculated result, it can flexibly cope with the case where the length and the like of the heat sensitive adhesive label R varies.

Figure 8:
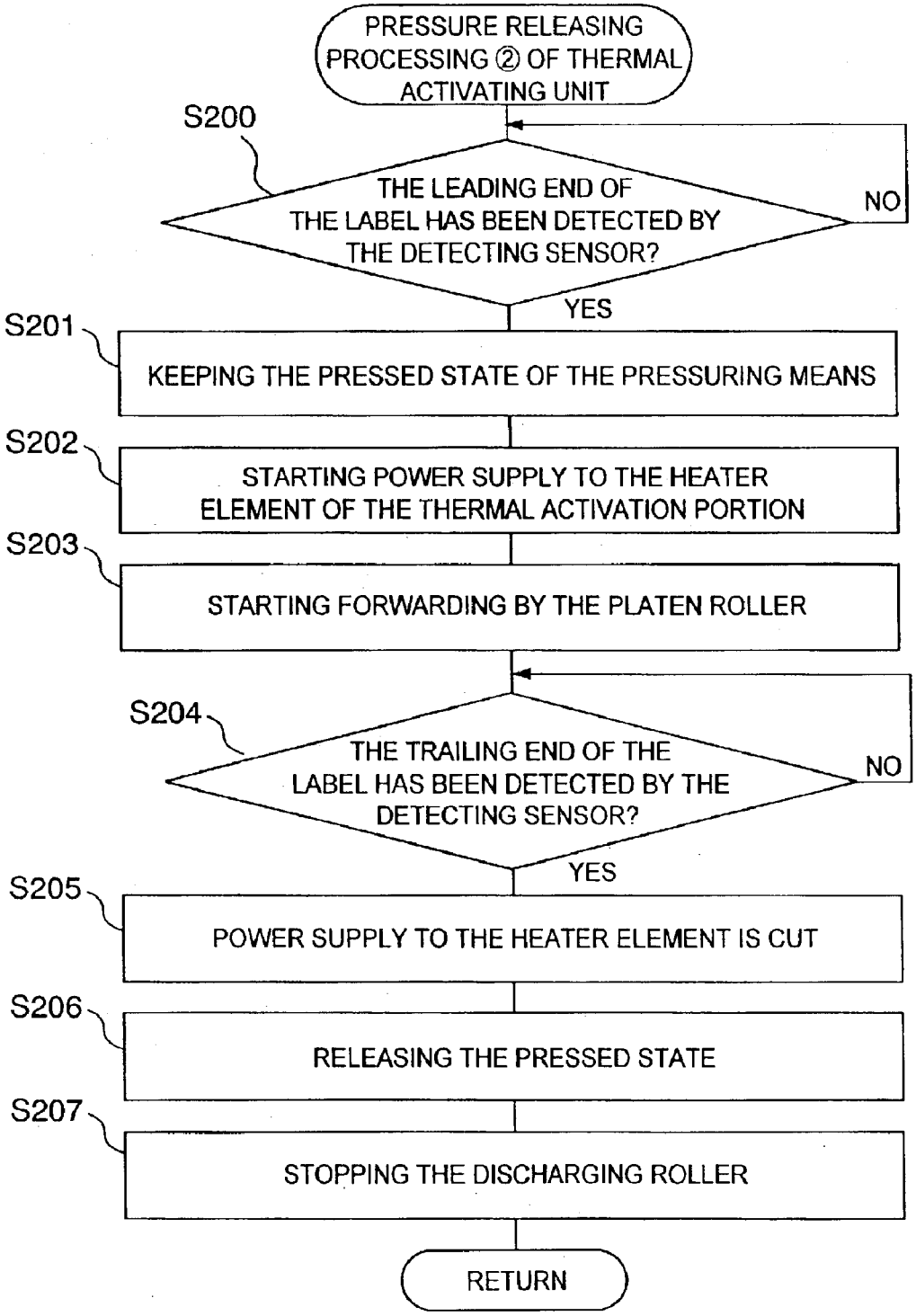
FIG. 8 is a flow chart showing the procedure of the pressure releasing processing ② of the thermal activating unit.
Figure 9:
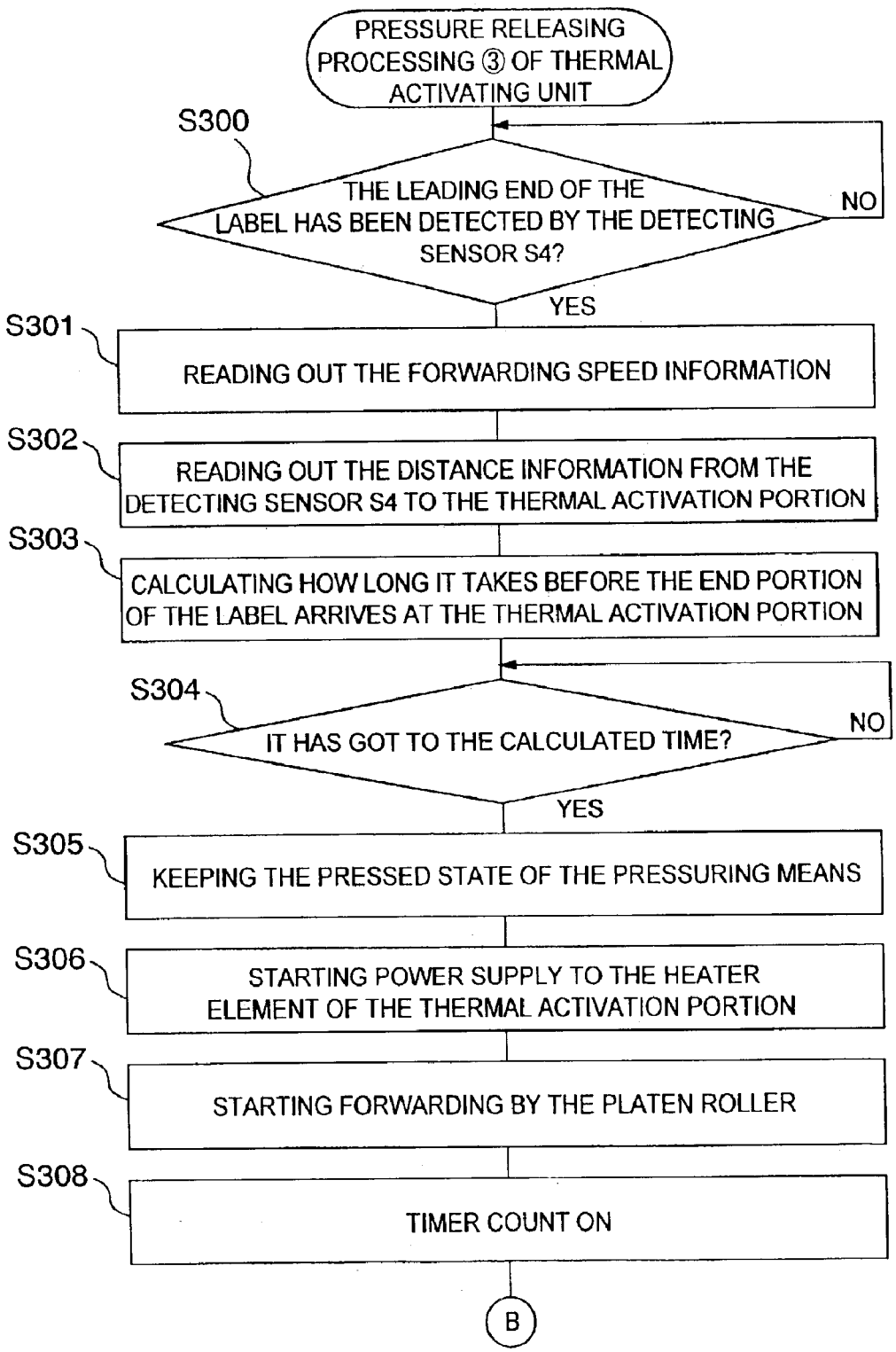
FIG. 9 is a flow chart showing the procedure of the pressure releasing processing ③ of the thermal activating unit.
Figure 10:
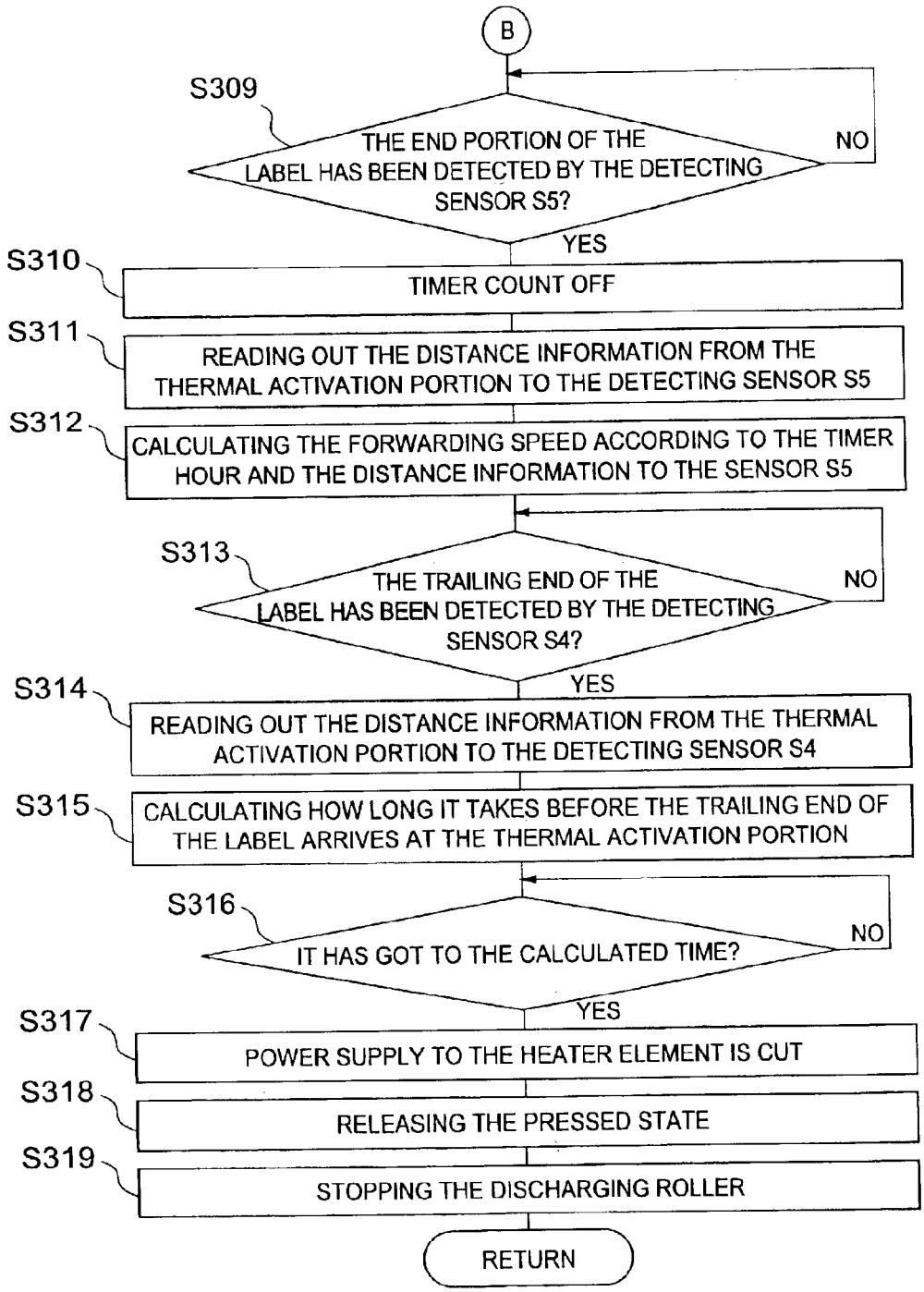
FIG. 10 is a flow chart showing the continuation of the processing of FIG. 9.
Figure 11:
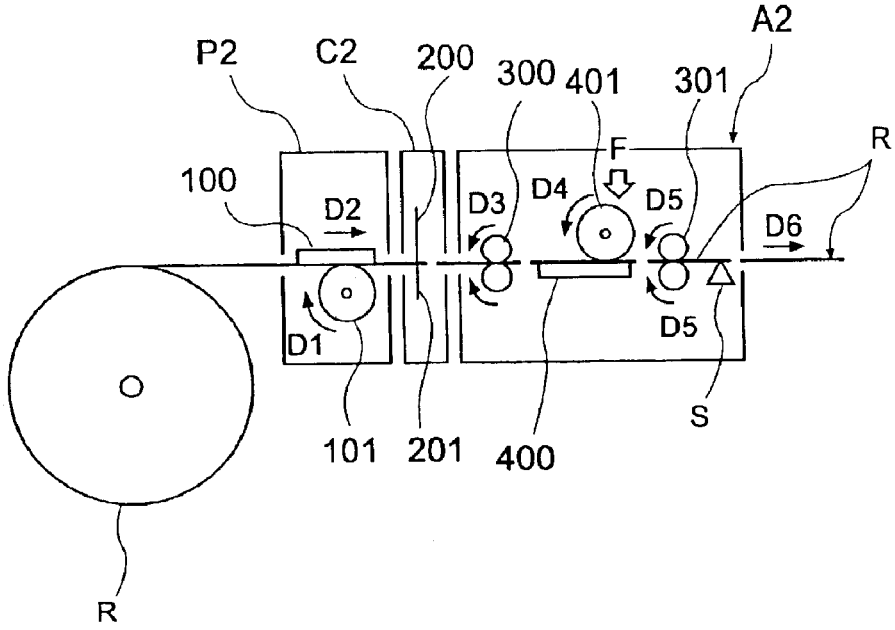
FIG. 11 PRIOR ART
FIG. 11 is a schematic view showing the structure of the conventional thermal printer.

This time, the procedure of the pressure releasing processing ② of the thermal activating unit in the case of providing one heat sensitive adhesive label detecting sensor S3 at the substantially same position as that of the thermal head 40 for thermal activation and the platen roller 41 for thermal activation, as illustrated in FIG. 4(*b*), with reference to the flow chart of FIG. 8.

When this processing is started, it is checked whether the heat sensitive adhesive label detecting sensor S3 has detected the leading end of the heat sensitive adhesive label R in Step S200, and when it is judged that it has detected, the procedure moves to Step S201, where the pressed state by the pressuring means is kept (namely, for example, in the case of using the cam mechanism, the eccentric cam 61 is attached to the moving mallet member 50 at the bottom dead center, as illustrated in FIG. 3(*a*), and in the case of using the solenoid, the telescopic rod 81 is in a contracted state (off-state), as illustrated in FIG. 5(*a*)) and the procedure moves to Step S202.

In Step S202, the power supply to the thermal activation portion (heater element H2) is started, and then, the procedure moves to Step S203, where the forwarding of the heat sensitive adhesive label R by the platen roller 41 for thermal activation is started. Thus, the thermal activation of the heat sensitive adhesive label R is started.

Next, in Step S204, it is checked whether the heat sensitive adhesive label detecting sensor S3 has detected the trailing end of the heat sensitive adhesive label R, and when it is judged that it has detected, the procedure moves to Step S205. In Step S205, the power supply to the heater element H2 is stopped and then the procedure moves to Step S206. This can save the power consumption when the thermal activation of the heat sensitive adhesive label R is not required.

In Step S206, the pressed state is released. Namely, for example, in the case of using the cam mechanism 60 as the pressure releasing means, as illustrated in FIG. 4, the third stepping motor M3 is driven so to rotate the eccentric cam 61, and as illustrated in FIG. 3(*b*), the moving mallet member 50 is lowered, so as to set the thermal head 40 for thermal activation apart from the platen roller 41 for thermal activation, thereby releasing the pressed state. In the case of using the solenoid 80 as the pressure releasing means, as illustrated in FIG. 5, the solenoid 80 is turned on, so to expand the telescopic rod 81 and raise the moving mallet member 51, as illustrated in FIG. 5(*b*), so as to set the thermal head 40 for thermal activation apart from the platen roller 41 for thermal activation, thereby releasing the pressed state. Then, the procedure moves to Step S207, where the rotation of the discharging roller 31 is stopped and returned. In these ways, the pressed state of the thermal head 40 for thermal activation toward the platen roller 41 for thermal activation can be released, thereby preventing the heat sensitive adhesive from attaching to the thermal head 40 for thermal activation and the platen roller 41 for thermal activation. In the pressure releasing processing ②, it is not necessary to calculate how long it takes before the leading end and the trailing end of the heat sensitive adhesive label R arrive at the heater element H2, and so on, differently from the pressure releasing processing ① described before, and therefore, the procedure is simple and the device control can be simplified The procedure of the pressure releasing processing ③ of the thermal activating unit in the case of providing the heat sensitive adhesive label detecting sensors S4 and S5 on the upstream and downstream sides from the thermal head 40 for thermal activation and the platen roller 41 for thermal activation, as illustrated in FIG. 4(*c*), with reference to the flow charts of FIG. 9 and FIG. 10.

When this processing is started, in Step S300, first it is checked whether the heat sensitive adhesive label detecting sensor S4 has detected the leading end of the heat sensitive adhesive label R, and when it is judged that it has detected, the procedure moves to Step S301. In Step S301, the forwarding speed information of the forwarding means (for example, the platen roller 41 for thermal activation) previously stored in the ROM 1010 or the RAM 1020 of the controller 1500 is read out, and then the procedure moves to Step S302.

In Step S302, the distance information from the heat sensitive adhesive label detecting sensor S4 to the thermal activation portion (the heater element H2 of the thermal head 40 for thermal activation), which has been previously stored in the ROM 1010 or the RAM 1020 of the controller 1500 is read out and then, the procedure moves to Step S303.

In Step S303, how long it takes before the end portion of the heat sensitive adhesive label R arrives at the heater element H2 is calculated and then the procedure moves to Step S304. In Step S304, it is checked whether it has got to the calculated time, and when it is judged that it has got to the above time, the procedure moves to Step S305.

In Step S305, the pressed state by the pressuring means is kept (namely, for example, in the case of using the cam mechanism, the eccentric cam 61 is attached to the moving mallet member 51 at the bottom dead center, as illustrated in FIG. 3(*a*), and in the case of using the solenoid, the telescopic rod 81 is in a contracted state (off-state), as illustrated in FIG. 5(*a*)) and the procedure moves to Step S306, where the power supply to the thermal activation portion (heater element H2) is started.

Then, the procedure moves to Step S307, where the forwarding of the heat sensitive adhesive label R by the platen roller 41 for thermal activation is started. Thus, the thermal activation of the heat sensitive adhesive label R is started.

Continuously, in Step S308, a timer counter is turned on and the procedure moves to Step S309, where it is checked whether the heat sensitive adhesive label detecting sensor S5 has detected the end portion of the heat sensitive adhesive label R, and when it is judged that it has detected, the procedure moves to Step S310. In Step S310, the timer counter is turned off and the procedure moves to Step S311, where the distance information from the heat sensitive adhesive label detecting sensor S5 to the thermal activation portion (the heater element H2 of the thermal head 40 for thermal activation) which has been previously stored in the ROM 1010 or the RAM 1020 of the controller 1500 is read out and the procedure moves to Step S312.

In Step S312, the forwarding speed of the heat sensitive adhesive label R is calculated from the time counted by the timer and the distance information (distance information/time) and the procedure moves to Step S313. In Step S313, it is checked whether the heat sensitive adhesive label detecting sensor S4 has detected the trailing end of the heat sensitive adhesive label R, and when it is judged that it has detected, the procedure moves to Step S314.

In Step S314, the distance information from the thermal activation portion (heater element H2) to the heat sensitive adhesive label detecting sensor S4 which has been previously stored in the ROM 1010 or the RAM 1020 of the controller 1500 is read out, and in Step S315, how long it takes before the tailing end of the heat sensitive adhesive label R arrives at the heater element H2 is calculated, and then the procedure moves to Step S316.

In Step S316, it is checked whether it has got to the calculated time, and when it is judged that it has got to the above time, the procedure moves to Step S317, where the power supply to the heater element H2 is cut, and then the procedure advances to Step S318. This can save the power consumption when the thermal activation of the heat sensitive adhesive label R is not required.

In Step S318, the pressed state is released. Namely, for example, in the case of using the cam mechanism 60 as the pressure releasing means, as illustrated in FIG. 4, the third stepping motor M3 is driven so to rotate the eccentric cam 61, and as illustrated in FIG. 3(*b*), the moving mallet member 50 is lowered, so as to set the thermal head 40 for thermal activation apart from the platen roller 41 for thermal activation, thereby releasing the pressed state. In the case of using the solenoid 80 as the pressure releasing means, as illustrated in FIG. 5, the solenoid 80 is turned on, so to expand the telescopic rod 81 and raise the moving mallet member 51, as illustrated in FIG. 5(*b*), so as to set the thermal head 40 for thermal activation apart from the platen roller 41 for thermal activation, thereby releasing the pressed state. Then, the procedure moves to Step S319, where the rotation of the discharging roller 31 is stopped and returned. In these ways, the pressed state of the thermal head 40 for thermal activation toward the platen roller 41 for thermal activation can be released, thereby preventing the heat sensitive adhesive from attaching to the thermal head 40 for thermal activation and the platen roller 41 for thermal activation. In the pressure releasing processing ③, since the system calculates how long it takes before the leading end and the trailing end of the heat sensitive adhesive label R arrive at the heater element H2, and so on and determines the timing for releasing the pressed state, according to the calculated results of the heat sensitive adhesive label detecting sensors S4 and S5, it can flexibly cope with the case where the length and the like of the heat sensitive adhesive label R varies.

Although the invention made by this inventor has been described more specifically according to the embodiments, it is not restricted to the above embodiments, but various modifications may be made without departing from the spirit thereof.

For example, two heat sensitive adhesive label detecting sensors may be provided on the upstream side from the thermal head 40 for thermal activation and the platen roller 41 for thermal activation, in the forwarding direction of the heat sensitive adhesive label R, and the timing for the pressure release can be determined, according to the detection results of the leading end and the trailing end of the heat sensitive adhesive label R by the respective detecting sensors.

In the embodiments, although the description has been made in the case of using the thermal method as a printer unit, it is not restricted to this, but an ink jet method, a laser printing method, and the like may be used. In this case, each surface treatment suitable to each printing method must be performed on a printing surface of the heat sensitive adhesive sheet, instead of the thermal coat layer.

As set forth hereinabove, the thermal activating device of the thermal activation sheet according to the invention comprises at least activation heating means for heating and activating the thermal activator layer of the thermal activation sheet with the thermal activator layer formed at least on one surface of a sheet-shaped substrate, forwarding means for forwarding the thermal activation sheet in a predetermined direction, and pushing means for pushing the thermal activation sheet toward the activation heating means, which is designed to comprise thermal activation sheet detecting means for detecting a presence of the thermal activation sheet at a predetermined position, and pressure releasing means for releasing a pressure working between the pushing means and the activation heating means when judging that the thermal activation sheet does not exist at the predetermined position according to the detection result of the thermal activation sheet detecting means. Therefore, the thermal activation sheet detecting means can detect a coming of the trailing end of the thermal activation sheet in the vicinity of the activation heating means, for example, and the pressure working between the pushing means and the activation heating means is released, according to the detection signal, thereby it is advantageous that the thermal activator can be prevented from attaching to the activation heating means and the pushing means.

What is claimed is:

1. A thermal activating device comprising:

activation heating means for heating and activating a heat sensitive adhesive on a thermal activator layer of a thermal activation sheet;

pressing means for pressing the thermal activation sheet into pressure contact with the activation heating means to heat and activate the heat sensitive adhesive on the thermal activator layer of the thermal activation sheet;

detecting means for detecting the presence of the thermal activation sheet at a predetermined position; and pressure releasing means for releasing the pressure contact between the thermal activation sheet and the activation heating means when the detecting means does not detect the presence of the thermal activation sheet at the predetermined position.

2. A thermal activating device according to claim 1; wherein the pressure releasing means includes means for releasing the pressure contact between the thermal activation sheet and the activation heating means by moving the activation heating means apart from the pressing means in a vertical direction.

3. A thermal activating device according to claim 2; wherein the activation heating means comprises an electric power source, and the pressing means comprises a platen roller and forcing means for forcing the platen roller toward the electric power source; and wherein the pressure releasing means includes moving means for moving one of the platen roller and the electric power source in the vertical direction or in a horizontal direction.

4. A thermal activating device according to claim 3; wherein the moving means comprises a mallet member disposed on a lower surface of the electric power source for movement therewith in the vertical direction, and a cam mechanism connected to a portion of the mallet member for moving the mallet member in the vertical direction; and wherein the forcing means comprises an elastic member disposed on the mallet member for elastically forcing the electric power source toward the platen roller, the cam mechanism being configured to move the mallet member against an elastic force of the elastic member when the detecting means does not detect the presence of the thermal activation sheet at the predetermined position.

5. A thermal activating device according to claim 3; wherein the moving means comprises a mallet member disposed on a lower surface of the electric power source for movement therewith in the vertical direction, and an actuator connected to a portion of the mallet member for moving the mallet member in the vertical direction; and wherein the forcing means comprises an elastic member for elastically forcing the electric power source toward the platen roller, the actuator being configured to move the mallet member against the elastic force of the elastic member when the detecting means does not detect the presence of the thermal activation sheet at the predetermined position.

6. A thermal activating device according to claim 5; wherein the actuator comprises one of a solenoid, a pneumatic cylinder, and a hydraulic cylinder.

7. A thermal activating device according to claim 3; wherein the moving means comprises a mallet member connected to the platen roller for movement therewith in the vertical direction, and a cam mechanism connected to a portion of the mallet member for moving the mallet member in the vertical direction; and wherein the forcing means comprises an elastic member disposed on the mallet member for elastically forcing the platen roller toward the electric power source, the cam mechanism being configured to move the mallet member against the elastic force of the elastic member when the detecting device does not detect the presence of the thermal activation sheet at the predetermined position.

8. A thermal activating device according to claim 3; wherein the moving means comprises a mallet member connected to the platen roller for movement therewith in the vertical direction, and an actuator connected to a portion of the mallet member for moving the mallet member in the vertical direction; and wherein the forcing means comprises an elastic member disposed on the mallet member for elastically forcing the platen roller toward the electric power source, the actuator being configured to move the mallet member against the elastic force of the elastic member when the detecting means does not detect the presence of the thermal activation sheet at the predetermined position.

9. A thermal activating device according to claim 8; wherein the actuator comprises one of a solenoid, a pneumatic cylinder, and a hydraulic cylinder.

10. A thermal activating device according to claim 3; wherein the activation heating means includes means for disabling a power supply to the electric power source when the pressure releasing means releases the pressure contact between the thermal activation sheet and the activation heating means.

11. A thermal activating device according to claim 3; wherein the electric power source comprises a thermal head having a plurality of aligned heater elements.

12. A thermal activating device according to claim 3; wherein the electric power source comprises a single resistive element.

13. A thermal activating device according to claim 3; wherein the electric power source comprises a thermal roll having a cylindrical resistive element.

14. A thermal activating device according to claim 3; further comprising feeding means for feeding the thermal activation sheet in a preselected direction, the feeding means having a driving source for rotationally driving the platen roller.

15. A thermal activating device according to claim 1; wherein the detecting means comprises an optical sensor for detecting the presence of a leading end or a trailing end of the thermal activation sheet.

16. A thermal activating device according to claim 1; wherein the detecting means comprises a microswitch for detecting the presence of a leading end or a trailing end of the thermal activation sheet.

17. A thermal activating device according to claim 1; further comprising forward moving means for moving the thermal activation sheet in a forward direction along a preselected path; and wherein the detecting means comprises a plurality of detectors disposed along the preselected path.

18. A thermal activating device according to claim 1; further comprising feeding means for feeding the thermal activation sheet in a preselected direction; and control means for controlling a moving speed or a moving cycle of the forward moving means, controlling an operational timing of the pressure releasing means in accordance with the preselected feeding direction and a length of the thermal activation sheet, controlling information corresponding to a distance between thermal activation sheet and the activation heating means, and controlling a detection result of the detecting means.

19. A thermal activating device according to claim 18; wherein the control means includes means for determining the preselected feeding direction and length of the thermal activation sheet in accordance with a detection result of the detecting means and the moving speed or the moving cycle of the feeding means.

20. A thermal activating device according to claim 18; wherein the detecting means comprises a plurality of detectors; and wherein the control means includes means for determining the moving speed of the feeding means in accordance with a detection result of each of the detectors.

21. A printer having the thermal activating device according to claim 1.

22. A printer according to claim 21; wherein the thermal activation sheet has a heat sensitive coloring layer; and further comprising a thermal head for printing on the thermal activation sheet while contacting the heat sensitive coloring layer.

23. A thermal activating device according to claim 1; wherein the thermal activation sheet comprises a substrate having the thermal activator layer on at least one surface thereof.

24. A thermal activating device according to claim 1; further comprising feeding means for feeding the thermal activation sheet in a preselected direction.

25. A thermal activating device according to claim 1; wherein the pressing means comprises an elastic member for elastically forcing the thermal activation sheet toward the activation heating means; and wherein the pressure releasing means comprises a mallet member on which the elastic member is disposed.

26. A thermal activating device comprising:

activation heating means for heating and activating a thermal activator layer of a thermal activation sheet;

pressing means for pressing the thermal activation sheet into pressure contact with the activation heating means to heat and activate the thermal activator layer of the thermal activation sheet;

detecting means for detecting the presence of the thermal activation sheet at a predetermined position; and pressure releasing means for releasing the pressure contact between the thermal activation sheet and the activation heating means when the detecting means does not detect the presence of the thermal activation sheet at the predetermined position, the pressure releasing means including means for releasing the pressure contact between the thermal activation sheet and the activation heating means by moving the activation heating means apart from the pressing means in a horizontal direction.

27. A thermal activating device comprising:

activation heating means for heating and activating a heat sensitive adhesive on a thermal activator layer of a thermal activation sheet;

a rotational member mounted to undergo rotation to feed the thermal activation sheet in a first direction along a movement path and to undergo movement in a second direction generally transverse to the first direction to bring the thermal activation sheet into pressure contact with the activation heating means for heating and activating the heat sensitive adhesive layer on the thermal activator layer of the thermal activation sheet;

at least one detector for detecting the presence of the thermal activation sheet at a preselected position along the movement path; and pressure releasing means for releasing the pressure contact between the thermal activation sheet and the activation heating means when the detector does not detect the presence of the thermal activation sheet at the preselected position along the movement path.

28. A thermal activating device according to claim 27; wherein the at least one detector comprises a plurality of detectors disposed at preselected positions along the movement path.

29. A thermal activating device according to claim 27; wherein the pressure releasing means comprises means for displacing the rotational member in a direction opposite to the second direction to release the pressure contact between the thermal activation sheet and the activation heating means.

30. A thermal activating device according to claim 27; wherein the detector comprises an optical sensor for detecting the presence of a leading end or a trailing end of the thermal activation sheet.

31. A thermal activating device according to claim 27; wherein the detector comprises a microswitch for detecting the presence of a leading end or a trailing end of the thermal activation sheet.

32. A thermal activating device according to claim 27; wherein the pressing means comprises an elastic member for elastically forcing the thermal activation sheet toward the activation heating means; and wherein the pressure releasing means comprises a mallet member on which the elastic member is disposed.

* * * * *